United States Patent [19]

Smith

[11] Patent Number: 4,500,590

[45] Date of Patent: Feb. 19, 1985

[54] DRYER FABRIC HAVING REDUCED PERMEABILITY IN THE AREA OF THE PINTLE JOINT

[75] Inventor: Richard W. Smith, Greenville, S.C.

[73] Assignee: Wangner Systems Corporation, Greenville, S.C.

[21] Appl. No.: 624,114

[22] Filed: Jun. 25, 1984

[51] Int. Cl.[3] ..... D04H 3/07; D21F 1/10

[52] U.S. Cl. ..... 428/222; 156/161; 162/348; 162/DIG. 1; 198/853; 198/857

[58] Field of Search ..... 156/161; 162/348, DIG. 1; 198/853, 857; 428/222

[56] References Cited

U.S. PATENT DOCUMENTS

| | | | |
|---|---|---|---|
| 4,345,730 | 8/1982 | Leuvelink | 428/222 |
| 4,351,874 | 9/1982 | Kirby | 428/257 |
| 4,362,776 | 12/1982 | Lefferts et al. | 198/853 |
| 4,381,612 | 5/1983 | Shank | 198/853 |
| 4,392,902 | 7/1983 | Lefferts | 428/222 |
| 4,395,308 | 7/1983 | Dawes | 428/397 |

*Primary Examiner*—James C. Cannon
*Attorney, Agent, or Firm*—Cort Flint

[57] ABSTRACT

A low permeability dryer fabric and method are disclosed which include a helical dryer fabric comprised of helix strips (12) whose winding arcs (16) are intermeshed and joined together by a composite pintle (A) to define a pintle joint. The composite pintle includes a polyester core (B) and an outer low-melt polymeric sheath (C) which has been heat softened and deformed and exhibits a profile (30) which occupies void areas in the mesh of the helical fabric in the area of the pintle joint.

25 Claims, 5 Drawing Figures

Fig. 1.
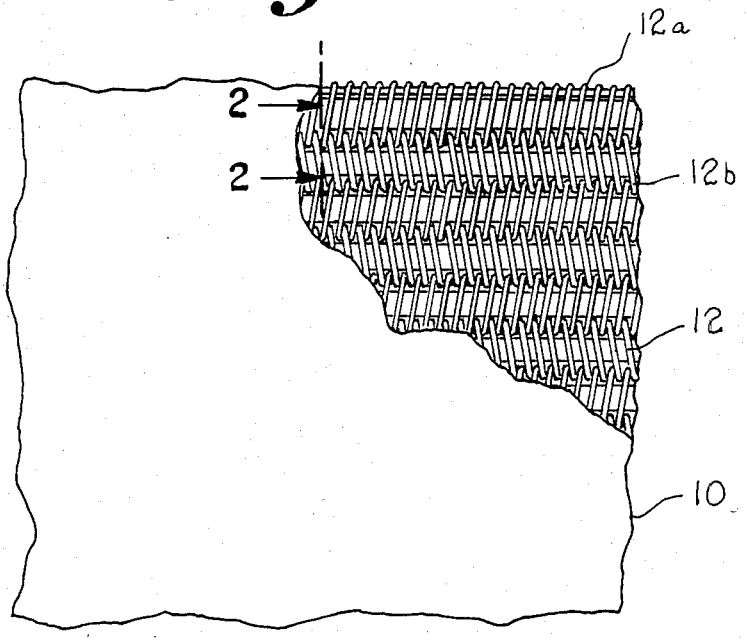
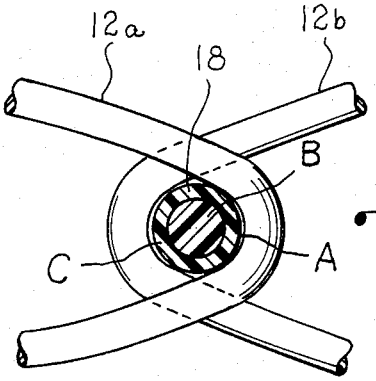
Fig. 2A.
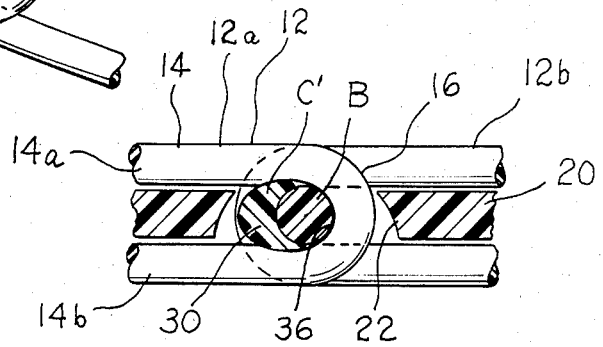
Fig. 2.

Fig. 4.
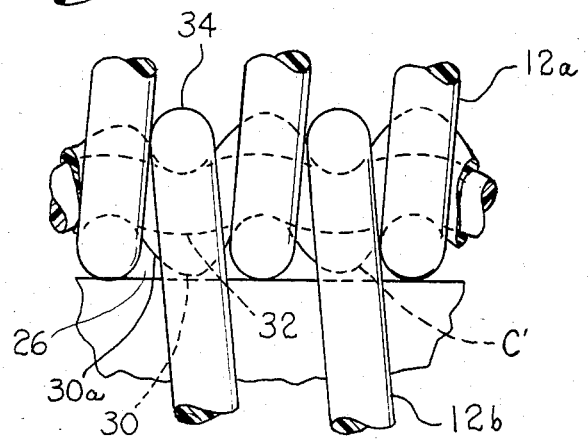
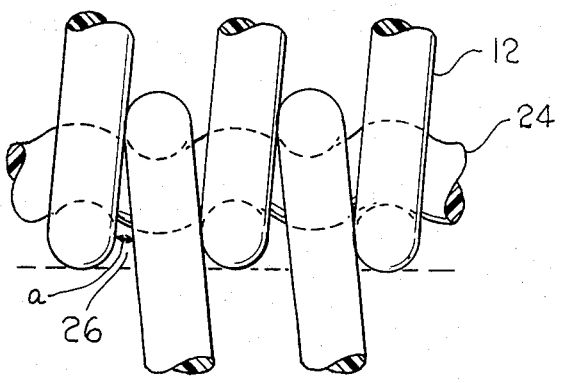
PRIOR ART
Fig. 3.

DRYER FABRIC HAVING REDUCED PERMEABILITY IN THE AREA OF THE PINTLE JOINT

BACKGROUND OF THE INVENTION

This invention relates to a dryer belt fabric for use in drying paper in the dryer section of a papermaking machine. In particular, the invention relates to a permeable dryer belt fabric of the type which includes a number of plastic helix strips whose winding arcs are joined together by means of a pintle to form a mesh fabric of desired dimension having an open mesh pattern. The helical fabric is normally formed from a thermosetable synthetic resin monofilament. The helical fabric is desirable because it provides a smooth flat surface having fewer knuckles than woven fabric to avoid marking up the paper which contacts the fabric belt while at the same time providing an increased surface area for supporting the paper. The plastic material and belt construction hold up extremely well under the stresses encountered when the belt is travelling endlessly at high speeds, typically 3,000 fpm, about the belt rollers for contacting the paper web being dryed on the dryer machine. Helical dryer fabric is shown in U.S. Pat. No. 4,346,138.

The high permeability of the helical plastic belt fabric provides increased pocket ventilation and drying. However, the problem occurs that the mesh of the helical fabric is considerably open and the permeability of the fabric needs to be reduced in many applications. In particular, for certain grades of paper, the permeability of the helical fabric is too high so that excessive air pumping occurs through the dryer fabric causing the paper web sheet to flutter excessively while being conveyed through the dryer section resulting in marking of the paper or even breaking of the web.

Proposals have been made for reducing the permeability of the helical fabric in paper drying applications. In U.S. Pat. No. 4,381,612 it has been proposed to insert a monofilament stuffer strand through the windings of the individual helix strips and seal the edges of the fabric so that the stuffer strips and helical fabric are made integral. In other embodiments, low-melt nylon strands are inserted in the windings of the helix strips. The strands are sized to insert easily within the windings. Once inserted, subsequent heat treatment causes the nylon strips to melt somewhat and flow to more desirably fill up the openness of the mesh pattern of the material and reduce the permeability. By this means, a helical dryer fabric is provided having good permeability characteristics in certain ranges of dryer fabric permeability. In U.S. Pat. No. 4,362,776 it is proposed to stuff the individual helix strips with a fibrous multi-filament material prior to their being joined together in the fabric to reduce the permeability.

In applicant's co-pending patent application Ser. No. 06/502,255, filed June 8, 1983, entitled LOW PERMEABILITY SPIRAL FABRIC AND METHOD, it is proposed to fill the windings of the individual helix strips with a contoured monofilament stuffing strand which has feathered edges that fit into the corner crevices of the intermeshing winding arcs located in the loop spaces of the windings. By this means, a heretofore open area of the helical mesh pattern that has been unable to be filled is partially closed off to reduce the permeability of the fabric and afford a low permeability characteristic which is desirable for many applications.

In U.S. Pat. No. 4,395,308 a helical fabric is disclosed for a dryer belt for drying paper which includes non-circular pintle strands. By utilizing non-circular cross-sectional monofilaments as pintle yarns to join the individual helix strips together, it is sought to reduce the open area in the mesh and reduce the permeability of the fabric without need of stuffing the windings with filler strands.

The above fabric constructions and methods have provided various ways of reducing dryer fabric permeability for a number of applications. Reducing the permeability of the helical mesh dryer fabric constructions even further is desirable to make their characteristics suitable for very fine grades of paper. Also, the reduction of permeability with decreased labor in the production methods and costs is sought in the development of these fabrics.

Accordingly, an important object of the present invention is to provide a dryer fabric and method for producing a dryer belt having reduced permeability characteristics.

Still another important object of the present invention is to provide a dryer fabric and method by which the permeability of a dryer belt may be reduced for drying paper which are achieved, in part, by using an already carried out step of pintle insertion but utilizing a unique pintle.

Still another important object of the present invention is to provide a dryer fabric and method by which the permeability in the pintle joint area of the dryer fabric is reduced without costly or labor extensive efforts.

Still another important object of the present invention is to provide a dryer fabric and method wherein a composite pintle is used which has a pintle core which forms a pintle joint and a surrounding sheath of a low-melt polymeric material which is caused to soften and deform under heat treatment to fill open areas adjacent the pintle joint.

SUMMARY OF THE INVENTION

The above objectives are accomplished according to the present invention by a dryer fabric construction of the type which includes a number of individual helix strips consisting of windings and winding arcs which are joined together by intermeshing the winding arcs of adjacent strips to form a pintle channel and inserting a pintle through the pintle channel to form a pintle joint and a helical mesh fabric having a mesh pattern with some void areas. The pintle is a composite pintle which includes a polyester core surrounded by a sheath of low-melt plastic material. In the fabric, the low-melt plastic material is deformed by heat treatment to where it projects into open spaces in an area of the pintle joint to reduce the air permeability in that area of the pintle joint. In accordance with the method, the composite pintle is inserted into the pintle channel to form the pintle joint. After the fabric is thus constructed by joining adjacent helix strips, the fabric is subjected to heat treatment under pressure which causes the winding arcs of the windings of the helix strips to penetrate the pintle core of the composite pintle causing the pintle core to be crimped. At the same time, the low-melt plastic material of the pintle sheath forms a softened melt which flows in the direction of the crimp of the pintle core to project into the void spaces adjacent the pintle joint to close off these spaces and reduce the permeability of the fabric. In addition, the integrity of the pintle joint is increased by the additional material present in this area. In a preferred form of the invention, the windings of the helix strips of the fabric have already been stuffed with a contoured monofilament stuffer strip as disclosed in applicant's co-pending application, described above, so that the overall permeability of the dryer fabric is reduced considerably providing a very low permeability characteristic for the fabric.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a plan view with part of the helical dryer fabric shown in detail;

FIG. 2 is a sectional view taken along line 2—2 of FIG. 1;

FIG. 2A is an elevation illustrating a pintle joint with a composite pintle yarn inserted in a channel of the pintle joint in accordance with the present invention;

FIG. 3 is a top plan view of a pintle joint such as found in the prior art; and FIG. 4 is a top plan view of a pintle joint formed by using a composite pintle wherein the fabric has been subjected to heat treatment causing a low-melt sheath material of the composite pintle to flow and form in open areas of the mesh surrounding the pintle joint to reduce the permeability of the fabric.

DESCRIPTION OF A PREFERRED EMBODIMENT

The invention relates to a dryer fabric for a dryer belt used to dry a paper web in the dryer section of a papermaking machine. In particular, the invention relates to reducing the permeability of dryer fabric of the helical fabric type. The helical fabric is typically made by joining together a number of helical strips by intermeshing their winding arcs and inserting a pintle through a channel formed by the intermeshing winding arcs to join the helix strips together. Such a fabric and helix strips may be made in accordance with the teachings disclosed in U.S. Pat. Nos. 4,381,612 and 4,392,092.

Referring now in more detail to the drawings, a section of a dryer belt 10 is illustrated which includes a plurality of helical strips 12 having windings 14. The windings 14 consist of top runs **14*a*, bottom runs 14*b*, and winding arcs 16** which join the top and bottom runs of the windings.

Adjacent helix strips such as **12*a* and 12*b* have their winding arcs 16 alternately intermeshed with each other to define a pintle channel 18 which receives a pintle means A. The pintle means A forms a pintle joint between the adjacent helix strips and joins the strips together. In this manner, a helical mesh fabric is constructed having an open mesh pattern defined generally between the spaced windings of the helix strips joined together in the fabric. A contoured monofilament filling strand 20 is preferably inserted within the windings 14 of each helix strip 12 across the width of the fabric to close the open mesh pattern of the fabric between the windings of the helix strips. The strand 20 may be any suitable polymeric material such as polyester manufactured by the Shakespear Co. of Columbia, S.C. as type WP-803. As illustrated, the contoured monofilament strands have a generally inverted trapezoidal cross-section so that a contoured edge 22 is provided that extends over an end portion of the winding arcs which protrude into the winding space of the helix strips, as can best be seen in FIG. 2**. This expedient is disclosed in applicant's co-pending application, described above, which teachings are hereby incorporated herein.

In accordance with the present invention, the pintle means A includes a core B of a suitable polymeric material and an outer sheath layer C of a suitable low-melt polymeric material. In a preferred embodiment, the core B is polyester and the sheath material C is a low-melt nylon. It is preferred that the layer of sheath material C comprise approximately twenty-five percent of the total diameter of the pintle means A. For example, if the diameter of the core B is 0.9 mm., then the thickness of the sheath layer is 0.3 mm. for a total pintle diameter of 1.2 mm. It is desired that the diameter of the pintle core B be equal to or larger than that of the diameter of the monofilament material of which the helix strips 12 are made. If the diameter of monofilament material of the helix strip 12 is 0.7 mm. for example, then the diameter of the pintle core is preferably 0.9 mm. The helix strips are preferably polyester material such as type WP0.809 manufactured by the Shakespear Company.

In the prior art, as can best be seen in FIG. 3, and as constructed in accordance with U.S. Pat. No. 4,392,092, the helical strips 12 are joined together by means of a pintle 24 which is inserted through the pintle channel defined by the intermeshing winding arcs of adjacent helix strips. The fabric so constructed is then placed on rollers and subjected to a heat treatment under pressure so that tension is placed on the windings of the helix strips and windings are flattened in an oval shape shown in FIG. 2. In this process, the pintle 24 is crimped such as shown in FIG. 3. This crimp amounts to approximately fifteen percent deformation of the pintle yarn 24 which was inserted in a generally straight configuration. As can be seen in FIG. 3, there is a space 26 created partially by the fact that the intermeshing winding arcs of adjacent helix strips are inclined to one another and this results in an angular separation "a" between the runs of the windings. This angular separation creates a void area in the fabric that cannot be entirely reached by a stuffing strand or strands inserted within the windings of the helix strips.

In accordance with the present invention, as can best be seen in FIG. 4, the sheath material C is deformed by softening the material under heat treatment and pressure so that the material flows and assumes a flow profile 30 that projects into the area 26 normally left open. The pintle core B is crimped and defines alternating bends 32 which extend in opposing directions from that of the knuckles 34 of the winding arcs. The interior bights 36 of the winding arcs pull against the pintle and penetrate the pintle to crimp the pintle during heat setting under tension as will be more fully described hereinafter. This causes the softened pintle sheath material to flow in the direction of the crimp or bends of the pintle core and assume the preferred profile 30 which projects into open spaces in the area of the pintle joint.

In accordance with the method, the helical strips are constructed in any suitable manner such as that disclosed in U.S. Pat. No. 4,392,902. The helix strips are joined together by intermeshing their winding arcs 16 and inserting the pintle means A through the channel of the intermeshed winding arcs to create a pintle joint and form the integral mesh fabric having an open mesh pattern as described heretofore. Prior to heat treatment and before tension, the windings 14 of the helical strips and pintle means A appear as shown in FIG. 2A. When subjected to heat treatment and tension, the runs of the windings 14 flatten out, as can best be seen in FIG. 2, and the pintle channel 18 assumes generally the diameter of that of the pintle core B.

The sheath material C is a low-melt polymeric material which, in accordance with the present invention, means that it will begin to soften or melt, and flow at a temperature of about 400 to 425 degrees Fahrenheit. This is also the temperature range in which the remaining material of the fabric will be heat set. The melt temperature of the remaining fabric is much higher than that of the low-melt sheath material and higher than the heat set temperature range. The fabric is heat set and is thus thermally stabilized so that its dimensions will remain unchanged within required tolerances during use at normal dryer operating temperatures, i.e. 250 to 350 degrees Fahrenheit. This heat setting is more fully described in U.S. Pat. Nos. 4,381,612 and 4,346,138, hereby incorporated herein.

A low-melt nylon is a suitable low-melt polymeric material. At a temperature in the range of 400 to 425 degrees Fahrenheit, the low-melt polymeric material will soften and begin to flow while the heat setting of the remaining fabric material and crimp of the core B occurs. The sheath material softens preferentially and flows to assume the preferred flow profile and projection into the void areas, as can best be seen in FIGS. 2 and 4.

The pintle core B deforms about 15% of its original diameter when crimped. The low-melt sheath material deforms about fifty percent. This means that the radius of the sheath material deforms about double the original thickness of the sheath layer as can best be seen in FIG. 2.

The fabric is placed on a frame and subjected to controlled heating, under tension, of the windings 14 of adjacent helix strips 12*a* and 12*b* pulling in opposing directions on the pintle means A causing the core B to crimp and the sheath material of C to flow in the directions of the crimp of the core B. After the fabric cools, the flow of low-melt material C assumes its solid properties prior to the heat treatment whereupon it occupies a considerable portion of the void spaces in the pintle joint area, as can best be seen in FIGS. 2 and 4. After heat treating, the fabric is removed from the frame and stuffer strands 20 are then inserted through the windings of the fabric. The fabric may then have its edges sealed to make the fabric structure integral.

By this means and method, a helical dryer fabric for a dryer belt is produced which has low permeability characteristics. In combination with the contoured monofilment filling strand 20, the overall permeability characteristic of the dryer fabric is very low making it suitable for fine paper grade applications.

While the pintle has been illustrated as an extruded polyester core and outer sheath surrounding the core, it is to be understood that the core may also be extruded or otherwise produced and then the low-melt sheath wrapped around the core material for insertion.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A permeable dryer belt fabric for use in drying paper in the dryer section of a paper making machine comprising:

a plurality of polymeric helix strips comprised of windings and winding arcs;

said helix strips being intermeshed together so that the winding arcs of adjacent helix strips intermesh with one another to define a pintle channel through said arcs;

a polymeric pintle core extending through said pintle channel to form a pintle joint and join adjacent helix strips together to form a mesh fabric having an open mesh pattern;

said pintle core having a crimped configuration with alternated bends engaged by a bight of alternating winding arcs of adjacent helix strips; and a low-melt polymeric material carried generally around said pintle core which has been heat softened so that said material flows and exhibits a flow profile projecting generally in the direction of said bends in said crimped pintle core to fill void areas in said mesh pattern in an area of said pintle joint, said low-melt material retaining its solid properties in said flow profile.

2. The fabric of claim 1 wherein said flow profile of polymeric material is tapered from said bight of said winding arc inwardly of said windings.

3. The fabric of claim 1 comprising pintle means which includes said pintle core and a sheath surrounding said core which includes said low-melt polymeric material which has been softened by heat treatment and solidified to produce said flow profile.

4. The fabric of claim 1 wherein said pintle core is a polyester core and said low-melt polymeric material includes a sheath of said low-melt polymeric material surrounding said polyester core which has deformed by heat treatment to produce said flow profile, said polyester core having a diameter corresponding to the diameter of said pintle channel for joining said helix strips together.

5. The fabric of claim 1 wherein said pintle core has a diameter generally equal to that of said pintle channel.

6. The fabric of claim 1 wherein said windings of adjacent helix strips joined by a common pintle core are inclined to one another resulting in an angular separation of adjoining winding arcs of adjacent helix strips, and said low-melt sheath material occupying a portion of a void area between said angularly separated windings.

7. A method for producing a permeable dryer belt fabric for use in drying paper in the dryer section of a papermaking machine wherein the dryer belt fabric is of the type which is produced by providing a plurality of helix strips having windings with winding arcs which have been joined together by intermeshing the winding arcs of adjacent helix strips with one another to define a pintle channel and inserting a pintle through said pintle channel to form a pintle joint which joins said helix strips together resulting in formation of a mesh fabric having an open mesh pattern, heat setting said joined intermeshing helix strips to cause said pintle to be crimped and exhibit alternating side bends due to the fabric being placed under a tension and said windings of the helix strips being caused to pull on said pintle in opposing directions, wherein said method comprises selecting a composite pintle having a polymeric core material and an outer sheath material which has a lower melt point than the core material so that said sheath material softens preferentially to flow in the direction of said alternating bends of said pintle core during heat treatment of said fabric whereby a profiled flow of said sheath material projects into a portion of the void spaces of said mesh pattern in an area of said pintle joint.

8. The method of claim 7 including inserting a stuffer strip within the windings of said helix strips in said fabric to reduce fabric permeability.

9. The method of claim 7 including sealing the edges of said fabric with said monofilament stuffer strip inserted.

10. The method of claim 7 including selecting said polymeric core material to be polyester and said sheath material to be a low-melt nylon.

11. The method of claim 7 wherein said sheath material is deformed to approximately fifty percent of its original configuration.

12. The method of claim 7 wherein said sheath material flows essentially to one side of said pintle core in the direction of crimp of said pintle core with knuckles of said winding arcs of said windings extending in the opposite directions.

13. The method of claim 7 wherein said sheath comprises a layer about said pintle core approximating about twenty-five percent of the diameter of said composite pintle.

14. A method for producing a dryer felt fabric for use in drying paper in the drying section of a papermaking machine comprising the steps of:

providing a plurality of polymeric helix strips each of which includes a number of windings and winding arcs;

intermeshing the winding arcs of adjacent helix strips together to define a pintle channel;

inserting a pintle means through said pintle channel to define a pintle joint joining said helix strips to one another to provide a mesh fabric having an open mesh pattern;

selecting said pintle means to include a polymeric core and a sheath of low-melt polymeric material surrounding said polymeric core which softens and deforms when subjected to heat treatment to flow in a preferential direction to fill void areas of said open mesh pattern at the pintle joint;

subjecting said fabric to heat treatment under tension causing said pintle core to come into contact with said winding arcs of said adjoined windings; and softening and deforming said polymeric sheath material by said heat treatment to cause said sheath material to flow and exhibit a flow profile in said preferential direction which reduces fabric permeability in an area of said pintle joint.

15. The method of claim 14 including subjecting said fabric to heat treatment under tension causing said pintle core to crimp and exhibit alternating side bends which alternate in accordance with said tension placed on said pintle core, said flow profile of said heat softened sheath material projecting in alternating directions in accordance with the alternating bends of said crimped pintle.

16. The method of claim 14 including inserting a monofilament stuffer strip through said windings of said helix strips to reduce the open area in said mesh pattern and the permeability of said fabric.

17. The method of claim 14 wherein said sheath comprises a layer about said pintle core approximating about twenty-five percent of the diameter of said composite pintle.

18. The method of claim 14 wherein said pintle sheath is deformed to approximately fifty percent of its original radius.

19. A permeable dryer belt fabric for use in drying paper in the dryer section of a papermaking machine of the type which includes a number of polymeric helix strips comprised of open loop windings and winding arcs, said helix strips being intermeshed together so that the winding arcs of adjacent helix strips intermesh with one another to define a pintle channel, and a pintle means extending through said pintle channel to form a pintle joint and join the adjacent helix strips together to provide a mesh fabric having an open mesh pattern, wherein said dryer belt fabric comprises:

said pintle means including a pintle core of polymeric material extending through said pintle channel contacting said winding arcs to join the adjacent helix strips together; and a sheath of low-melt polymeric material generally surrounding said pintle core which is of a low-melt polymeric material which has been softened and deformed by heat treatment; so that said low-melt material exhibits a flow profile which projects into void spaces of said mesh pattern in an area of said pintle joint to reduce the permeability of the fabric.

20. The fabric of claim 19 including an elongated monofilament stuffer strip inserted through the winding loops of said helix strips in said fabric.

21. The fabric of claim 19 wherein said pintle core is a polyester and said sheath is a low-melt nylon.

22. The fabric of claim 19 wherein said pintle core has a diameter generally equal to that of said pintle channel.

23. The fabric of claim 19 wherein said sheath comprises approximately twenty-five percent of the diameter of said pintle means prior to heat treatment.

24. A method for producing a dryer felt fabric for use in drying paper in the drying section of a papermaking machine comprising the steps of:

providing a plurality of polymeric helix strips each of which includes a number of windings and winding arcs;

intermeshing the winding arcs of adjacent helix strips together to define a pintle channel;

inserting a pintle means through said pintle channel to define a pintle joint joining said helix strips to one another to provide a mesh fabric having an open mesh pattern;

selecting said pintle means to include a polymeric core and a sheath of low-melt polymeric material surrounding said polymeric core which softens and deforms when subjected to heat treatment to flow in a preferential direction to fill void areas of said open mesh pattern at the pintle joint;

subjecting said fabric to heat treatment causing said low-melt polymeric material to soften and deform so that said sheath material flows into void areas surrounding said pintle joint to reduce fabric permeability in the area of said pintle joint.

25. The method of claim 24 wherein said polymeric core includes polyester and said sheath material includes a low-melt nylon material.

* * * * *